US010780489B2

(12) United States Patent
Kho

(10) Patent No.: US 10,780,489 B2
(45) Date of Patent: Sep. 22, 2020

(54) TOOL-FREE OPENING TAPE FEED RECEIVER FOR A SELF-PIERCING RIVET MACHINE

(71) Applicant: Newfrey LLC, New Britain, CT (US)

(72) Inventor: Chuan Meng Kho, Troy, MI (US)

(73) Assignee: Newfrey LLC, New Britain, CT (US)

( * ) Notice: Subject to any disclaimer, the term of this patent is extended or adjusted under 35 U.S.C. 154(b) by 402 days.

(21) Appl. No.: 15/901,264

(22) Filed: Feb. 21, 2018

(65) Prior Publication Data

US 2019/0255596 A1 Aug. 22, 2019

(51) Int. Cl.

| | |
|---|---|
| ***B21J 15/32*** | (2006.01) |
| ***B21J 15/02*** | (2006.01) |
| ***B65H 20/36*** | (2006.01) |
| ***B65H 37/00*** | (2006.01) |

(52) U.S. Cl.

CPC ..... *B21J 15/323* (2013.01); *B21J 15/025* (2013.01); *B65H 20/36* (2013.01); *B65H 37/002* (2013.01); *B65H 2701/1942* (2013.01)

(58) Field of Classification Search

None

See application file for complete search history.

(56) References Cited

U.S. PATENT DOCUMENTS

| | | | |
|---|---|---|---|
| 1,967,056 | A | 7/1934 | Horton |
| 3,208,657 | A | 9/1965 | Cohn |
| 3,456,445 | A | 7/1969 | Bentele et al. |
| 3,543,987 | A | 12/1970 | Obergfell et al. |
| 3,920,130 | A | 11/1975 | Edgett |
| 4,015,799 | A | 4/1977 | Koski et al. |
| 4,089,009 | A | 5/1978 | Frazier |

(Continued)

FOREIGN PATENT DOCUMENTS

| | | | |
|---|---|---|---|
| EP | 0593970 | A1 | 4/1994 |
| EP | 2498934 | A1 | 9/2012 |

(Continued)

OTHER PUBLICATIONS

U.S. Appl. No. 15/901,236, filed Feb. 21, 2018, Chuan Meng Kho.

(Continued)

*Primary Examiner* — Hemant Desai
*Assistant Examiner* — Tanzim Imam
(74) *Attorney, Agent, or Firm* — Harness, Dickey & Pierce, P.L.C.

(57) ABSTRACT

A self-piercing rivet tape path can extend through a clamshell receiver assembly between the upper and lower receiver bodies and can open between the upper and lower bodies along a longitudinal length of the self-piercing rivet tape path that extends through the clamshell receiver assembly. The upper and lower bodies can separate at a lead rivet cavity and above a proximal end of a discharge cavity of the lower body. A tool-free interlock coupling can rigidly couple the upper and lower receiver bodies together in a closed position. This tool-free coupling can unlock the upper and lower receiver bodies so they are hingedly movable into the open position. The clamshell receiver assembly can be rigidly coupled to an end of a self-piercing rivet spindle to receive self-piercing rivets carried by the tape along the tape path and support a lead self-piercing rivet in alignment with a punch of the spindle.

30 Claims, 8 Drawing Sheets

(56) References Cited

U.S. PATENT DOCUMENTS

| | | | |
|---|---|---|---|
| 4,119,258 | A | 10/1978 | Ewig, Jr. |
| 4,133,102 | A | 1/1979 | Gillemot |
| 4,319,705 | A | 3/1982 | Geist et al. |
| RE30,939 | E | 5/1982 | d'Alayer de Costemore d'Arc et al. |
| 4,404,742 | A | 9/1983 | Fuhrmeister |
| 4,410,103 | A | 10/1983 | Fuhrmeister |
| 4,615,475 | A | 10/1986 | Fuhrmeister |
| 4,716,124 | A | 12/1987 | Yerman et al. |
| 4,788,558 | A | 11/1988 | Caldwell et al. |
| 4,942,996 | A | 7/1990 | Wolfberg et al. |
| 5,032,211 | A | 7/1991 | Shinno et al. |
| 5,184,497 | A | 2/1993 | Hanlon et al. |
| 5,191,693 | A | 3/1993 | Umetsu |
| 5,267,401 | A | 12/1993 | Freeman et al. |
| 5,339,983 | A | 8/1994 | Caple |
| 5,388,721 | A | 2/1995 | Mauer |
| 5,454,900 | A | 10/1995 | Han et al. |
| 5,542,323 | A | 8/1996 | Habermehl et al. |
| 5,755,519 | A | 5/1998 | Klinefelter |
| 5,779,127 | A | 7/1998 | Blacket et al. |
| 5,813,114 | A | 9/1998 | Blacket et al. |
| 6,089,437 | A | 7/2000 | Blacket et al. |
| 6,116,835 | A | 9/2000 | Blacket et al. |
| 6,164,489 | A | 12/2000 | Altrock |
| 6,266,871 | B1 | 7/2001 | Edwards |
| 6,502,783 | B1 | 1/2003 | Smith et al. |
| 6,536,660 | B2 | 3/2003 | Blankenship et al. |
| 6,592,015 | B1 | 7/2003 | Gostylla et al. |
| 6,828,743 | B2 | 12/2004 | Debuf |
| 6,942,134 | B2 | 9/2005 | Naito |
| 6,963,351 | B2 | 11/2005 | Squires et al. |
| 7,131,564 | B2 | 11/2006 | Matthews et al. |
| 7,212,637 | B2 | 5/2007 | Salisbury |
| 7,726,598 | B2 | 6/2010 | Morelli et al. |
| 7,896,212 | B2 | 3/2011 | Uejima et al. |
| 8,915,460 | B2 | 12/2014 | Busch et al. |
| 8,950,049 | B2 | 2/2015 | Williams |
| 9,120,141 | B2 | 9/2015 | Clew et al. |
| 9,457,921 | B2 | 10/2016 | Barnes et al. |
| 2004/0136768 | A1 | 7/2004 | Klinefelter et al. |
| 2005/0284910 | A1* | 12/2005 | Craythorn ..... B21J 15/025 227/112 |
| 2006/0090320 | A1* | 5/2006 | Matthews ..... B21J 15/32 29/407.09 |
| 2006/0266869 | A1 | 11/2006 | Quittkat |
| 2008/0230646 | A1 | 9/2008 | Morelli et al. |
| 2008/0251559 | A1 | 10/2008 | Uejima et al. |
| 2013/0047425 | A1* | 2/2013 | Kikuchi ..... B21J 15/32 29/809 |
| 2013/0223956 | A1 | 8/2013 | Gostylla |
| 2014/0000419 | A1* | 1/2014 | Park ..... B25B 23/045 81/434 |
| 2014/0182123 | A1* | 7/2014 | Krejci ..... B23P 19/001 29/809 |
| 2014/0217227 | A1 | 8/2014 | Kilibarda et al. |
| 2014/0260831 | A1 | 9/2014 | Hays et al. |
| 2015/0101175 | A1 | 4/2015 | Xi et al. |

FOREIGN PATENT DOCUMENTS

| | | | |
|---|---|---|---|
| EP | 2953772 | A1 | 12/2015 |
| WO | WO-93/01014 | A1 | 1/1993 |
| WO | WO-96/28266 | A1 | 9/1996 |
| WO | WO 2011/058297 | A1 | 5/2011 |
| WO | WO-2012/046002 | A2 | 4/2012 |
| WO | WO-2014/124007 | A1 | 8/2014 |

OTHER PUBLICATIONS

U.S. Appl. No. 15/901,312, filed Feb. 21, 2018, Jonathan MacDougall.
International Search Report and Written Opinion dated May 17, 2019 in corresponding International Application No. PCT/US2019/018922.

* cited by examiner

TOOL-FREE OPENING TAPE FEED RECEIVER FOR A SELF-PIERCING RIVET MACHINE

FIELD

The present disclosure relates to a tape feed receiver for a self-piercing rivet fastener machine.

BACKGROUND

This section provides background information related to the present disclosure which is not necessarily prior art.

Existing self-piercing rivet receivers for self-piercing rivet machines are typically made of several components that are bolted together. Such a structure has been understood to be necessary to provide the relative rigidity and positioning accuracy between the coupled components that is necessary to minimize problems as the self-piercing rivet punch engages the self-piercing rivet in the receiver and drives the rivet through a discharge passage and out of the receiver. The rigidity and positioning accuracy of the discharge passage into which the punch pushes the rivet at its proximal end, and pushes the rivet through the discharge passage, and pushes the rivet out of the discharge passage at its distal end relative to the rivet holding cavity has been believed to be particularly important.

Even so, there are sometimes problems that occur within the receiver making it necessary to uncouple the receiver components to access the interior of the receiver, for example, to clear a jammed self-piercing rivet. Because such receiver components are bolted together, disassembly of the components requires an operator to obtain and use tools to disassemble the receiver to access the interior of the receiver and to then reassemble the receiver together. This means the user must keep track of each of the various receiver components as they are uncoupled from each other, each of the bolts as they are removed from the assembly, and each of the required tools or spend time looking for any of these items that becomes misplaced. Although this increases the amount of time a manufacturing assembly line with such self-piercing rivet machines must be shut down to deal with such problems, it has been believed that this was a necessary evil in order to obtain the required relative rigidity and positioning accuracy between the coupled components of the receiver.

SUMMARY

This section provides a general summary of the disclosure, and is not a comprehensive disclosure of its full scope or all of its features.

In accordance with one aspect of the present disclosure, a tool-free clamshell opening tape feed receiver assembly for a self-piercing rivet machine can include an upper receiver body and a lower receiver body hingedly coupled together to form the clamshell receiver assembly. A self-piercing rivet tape path can extend through the clamshell receiver assembly between the upper and lower receiver bodies in a closed position. The clamshell receiver assembly can open into an open position between the upper and lower receiver bodies along a longitudinal length of the self-piercing rivet tape path that extends through the clamshell receiver assembly. A tool-free interlock coupling can have a locked configuration in which the upper and lower receiver bodies of the clamshell receiver assembly are rigidly coupled together in the closed position. The tool-free interlock coupling can have an unlocked configuration in which the upper and lower receiver bodies of the clamshell receiver assembly are hingedly movable into the open position. The clamshell receiver assembly can be rigidly coupled to an end of a self-piercing rivet spindle to receive self-piercing rivets carried by the tape along the tape path and support a lead self-piercing rivet in alignment with a punch of the spindle.

In accordance with one aspect of the present disclosure, a tool-free clamshell opening tape feed receiver assembly for a self-piercing rivet machine can include an upper receiver body and a lower receiver body hingedly coupled together to form the clamshell receiver assembly. A self-piercing rivet tape path can extend through the clamshell receiver assembly between the upper and lower receiver bodies in a closed position. The clamshell receiver assembly can open into an open position between the upper and lower receiver bodies along a longitudinal length of the self-piercing rivet tape path extending through the clamshell receiver assembly. A tool-free interlock coupling can have a locked configuration in which the upper and lower receiver bodies of the clamshell receiver assembly are rigidly coupled together in the closed position. The tool-free interlock coupling can have an unlocked configuration in which the upper and lower receiver bodies of the clamshell receiver assembly are hingedly movable into the open position. The clamshell receiver assembly can be rigidly coupled to an end of a self-piercing rivet spindle to receive self-piercing rivets carried by the tape along the tape path and support a lead self-piercing rivet in alignment with a punch of the spindle. The lower receiver body can define a self-piercing rivet discharge passage that can extend from a proximal end adjacent the tape path to a distal end at which the lower receiver body is engageable with a workpiece. The discharge passage can be designed to receive a self-piercing rivet from a tape extending along the tape path through the discharge passage proximal end and to pass the self-piercing rivet through the discharge passage and out of the discharge passage through its distal end.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
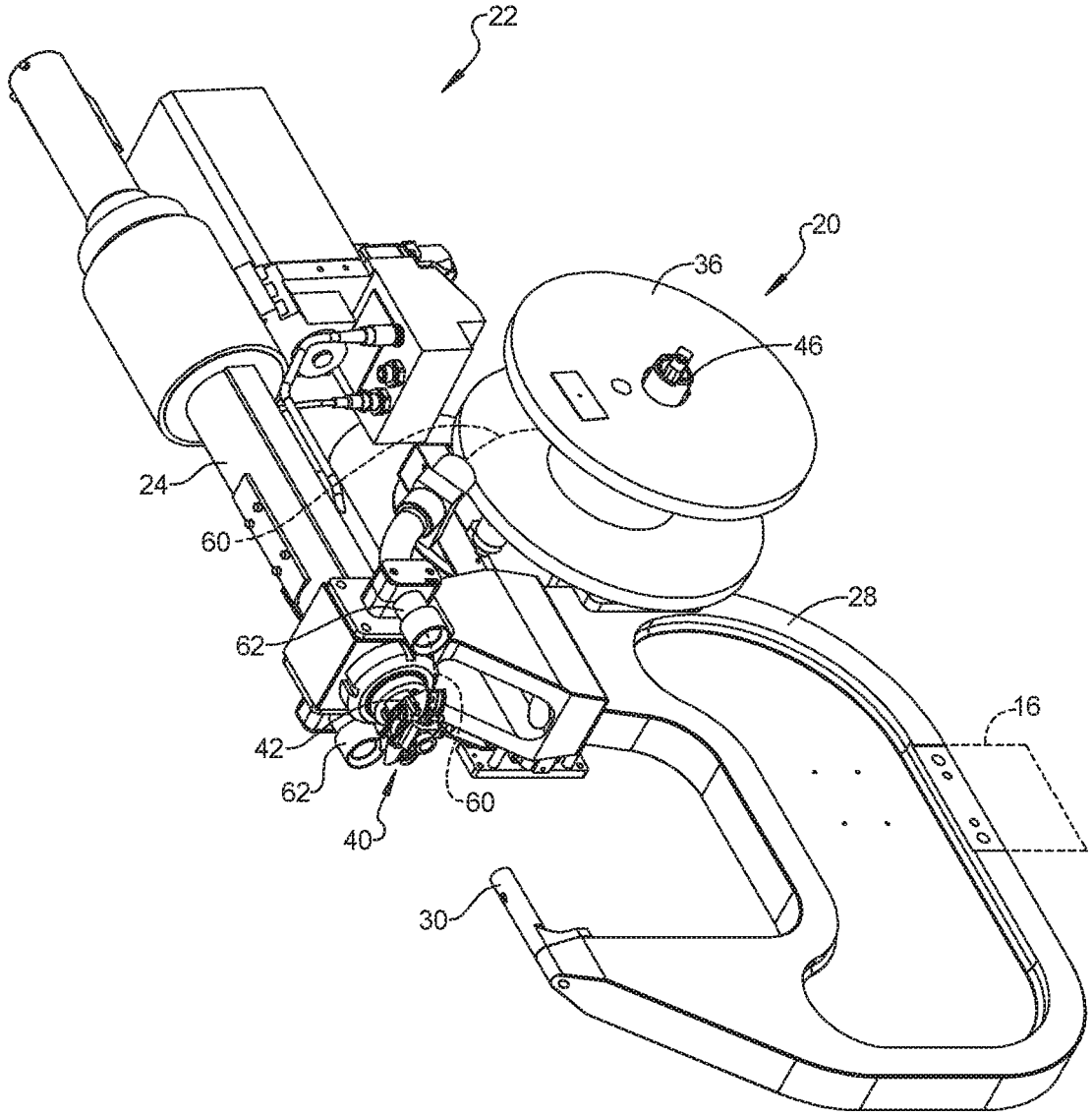
FIG. 1 is a perspective view of an example of a self-piercing rivet fastener machine including an example tape feed apparatus in accordance with the present disclosure.
Figure 2:
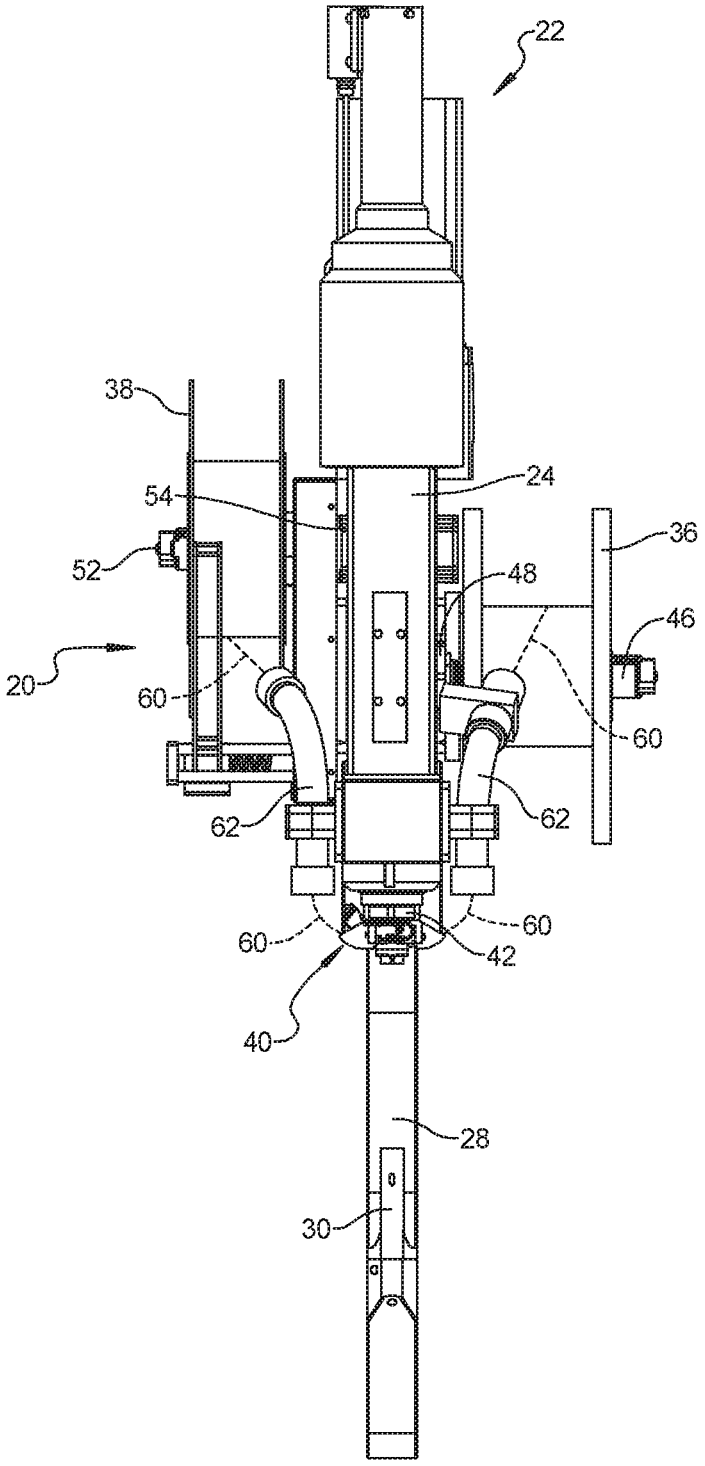
FIG. 2 is a front elevation view of the self-piercing rivet fastener machine and the tape feed apparatus of FIG. 1.
Figure 3:
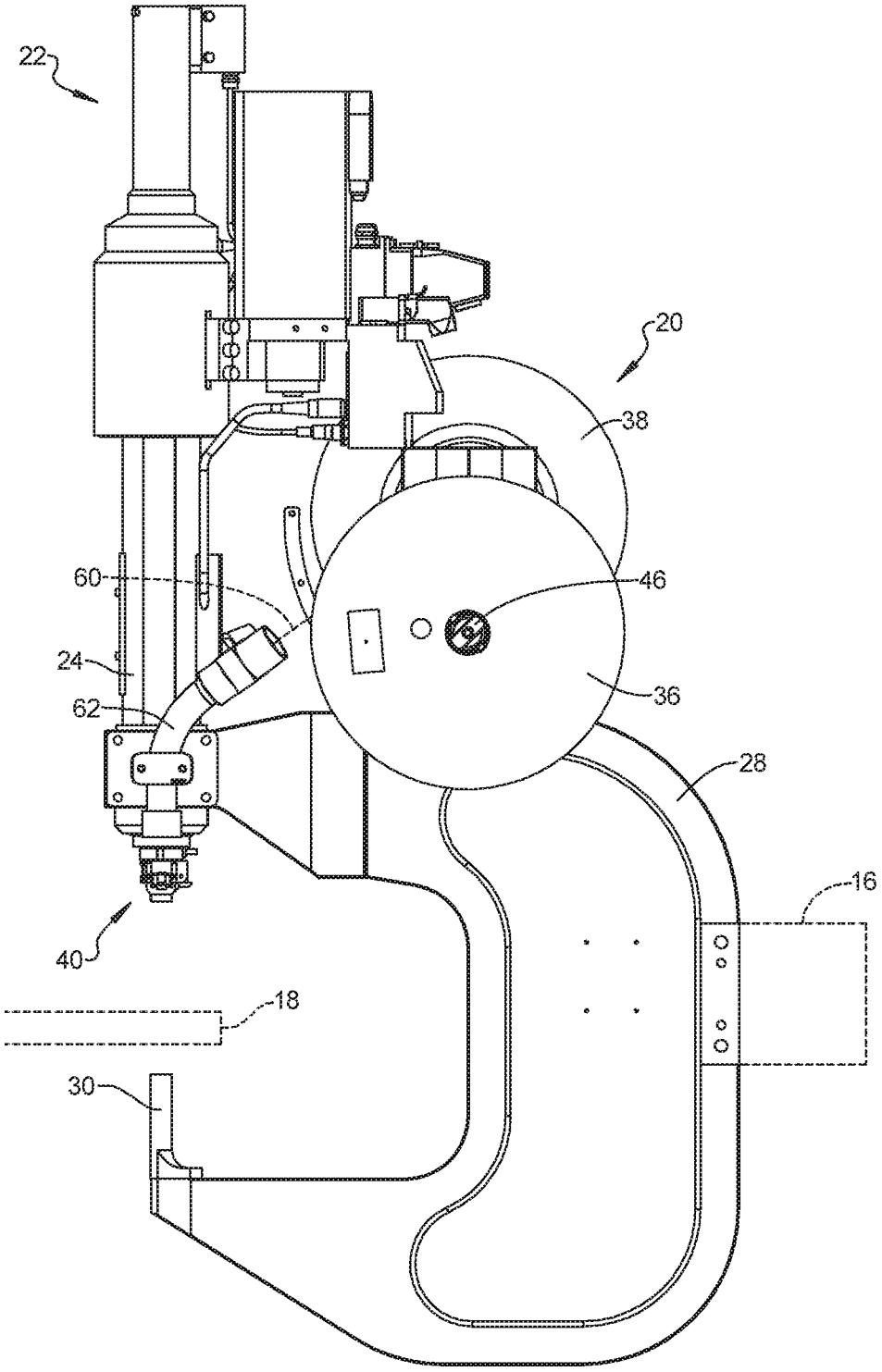
FIG. 3 is a side elevation view of the self-piercing rivet fastener machine and the tape feed apparatus of FIG. 1.
Figure 4:
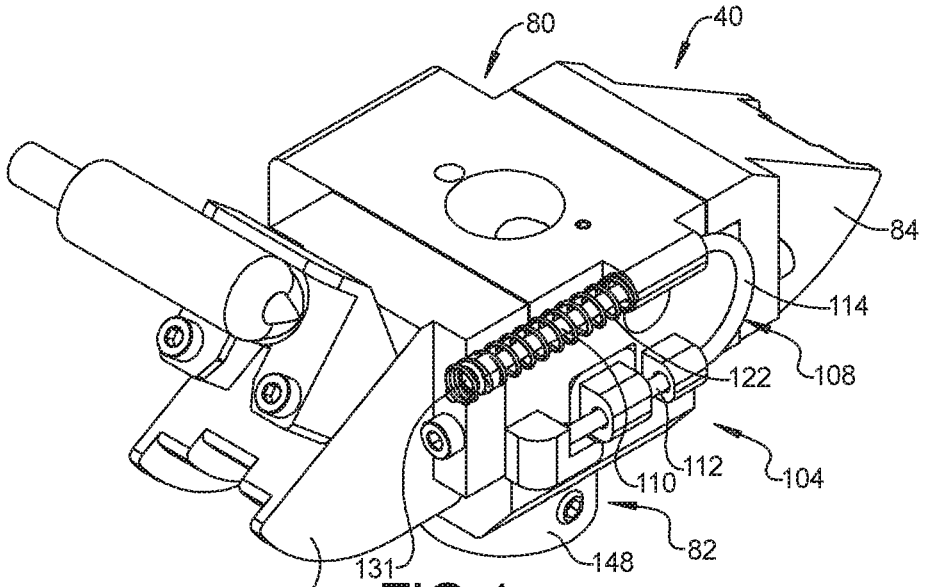
FIG. 4 is a perspective view of the receiver assembly of the tape feed apparatus of FIG. 1.
Figure 5:
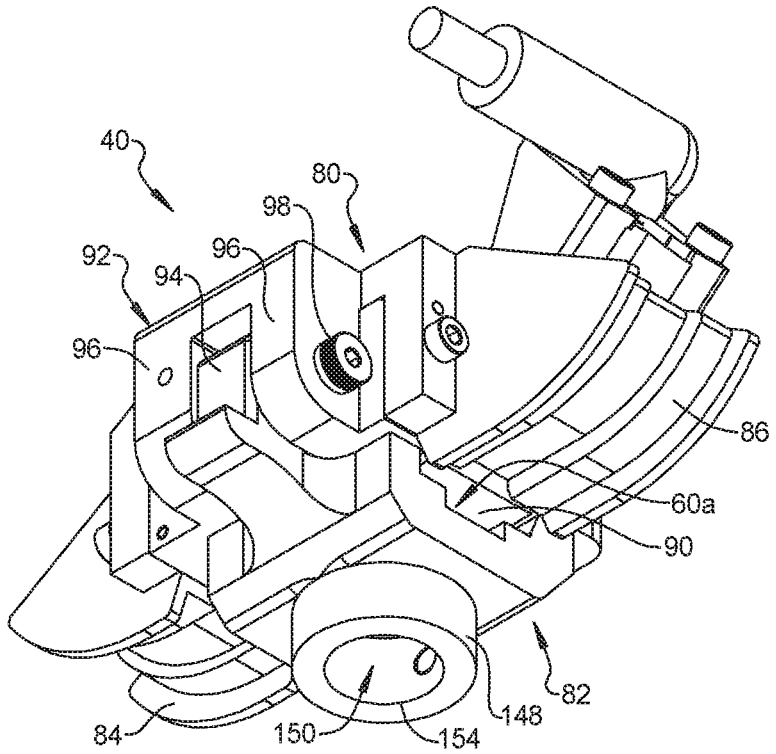
FIG. 5 is another perspective view of the receiver assembly of the tape feed apparatus of FIG. 1.
Figure 6:
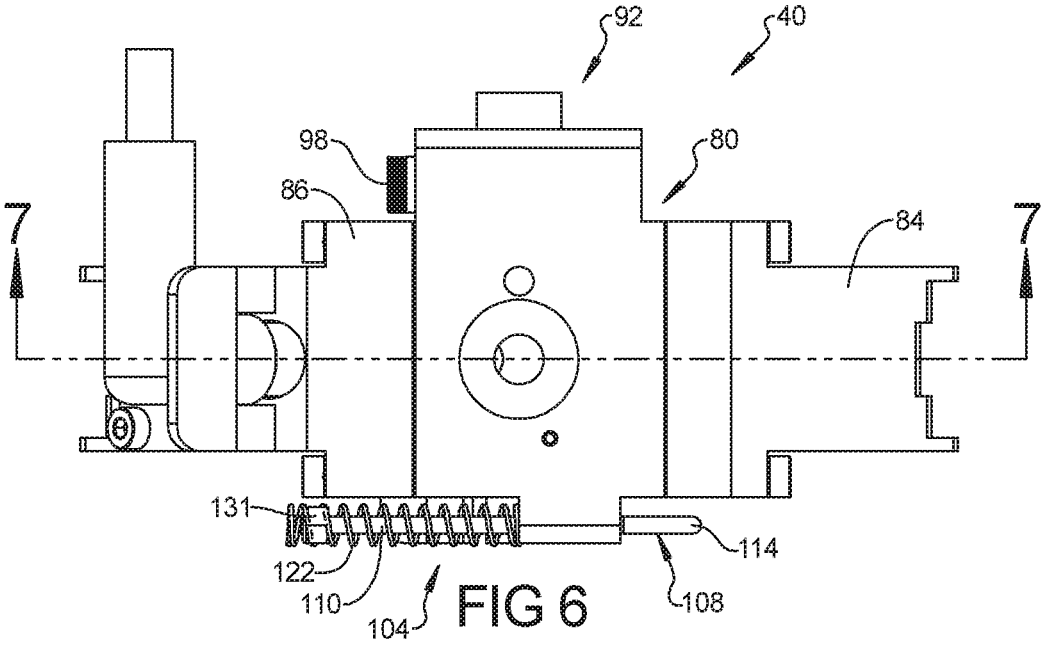
FIG. 6 is a top plan view of the receiver assembly of the tape feed apparatus of FIG. 1.
Figure 7:
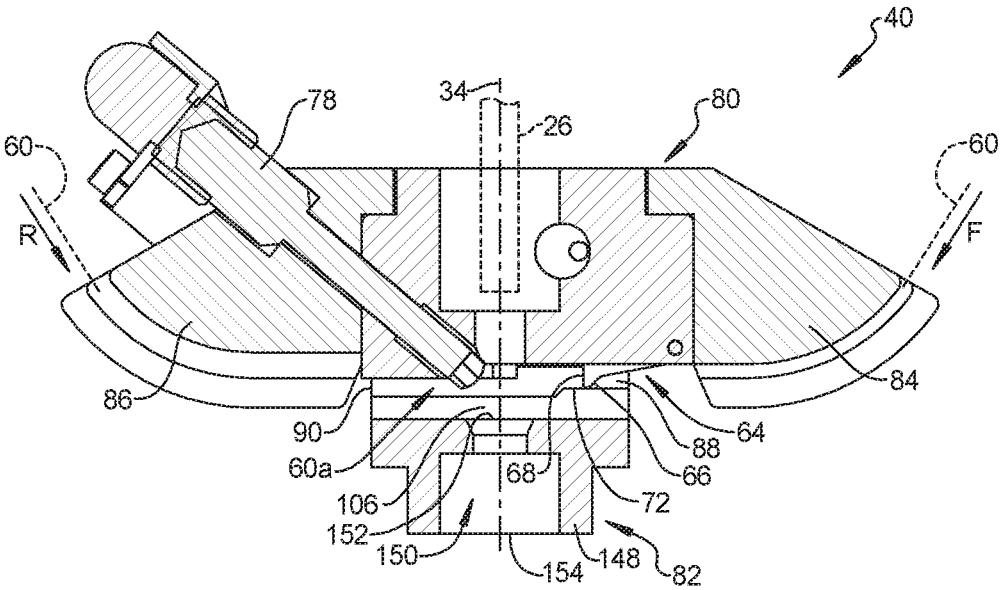
FIG. 7 is a cross-section view of the receiver assembly taken along line 7-7 of FIG. 6.
Figure 8:
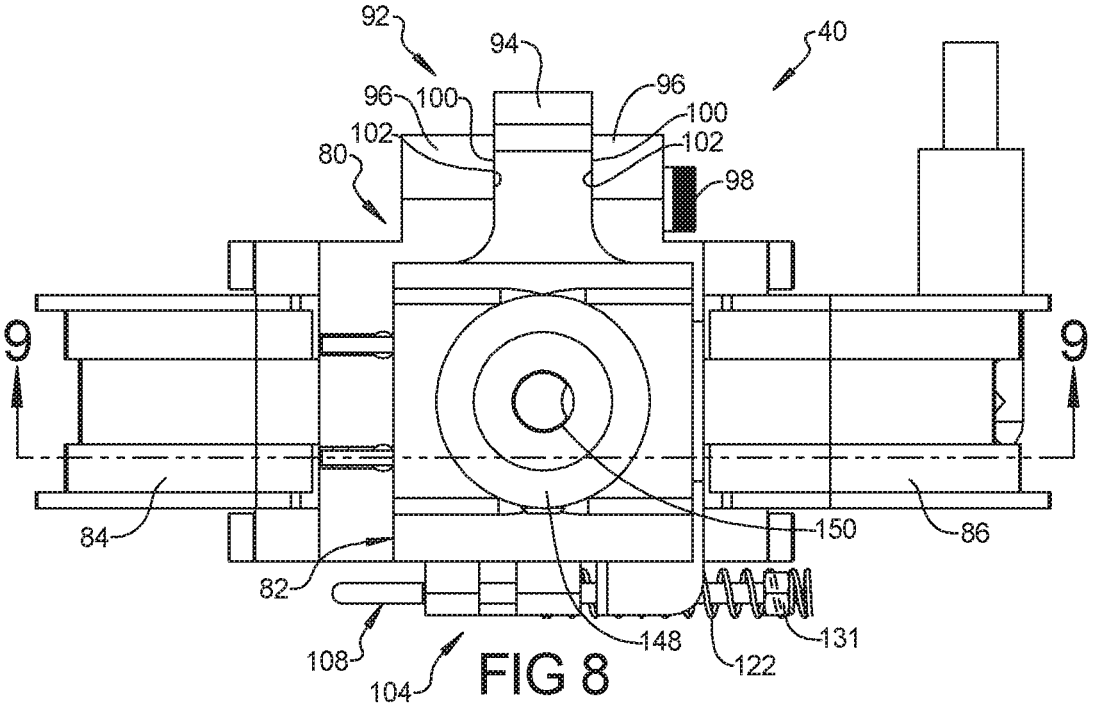
FIG. 8 is a bottom plan view of the receiver assembly of the tape feed apparatus of FIG. 1.
Figure 9:
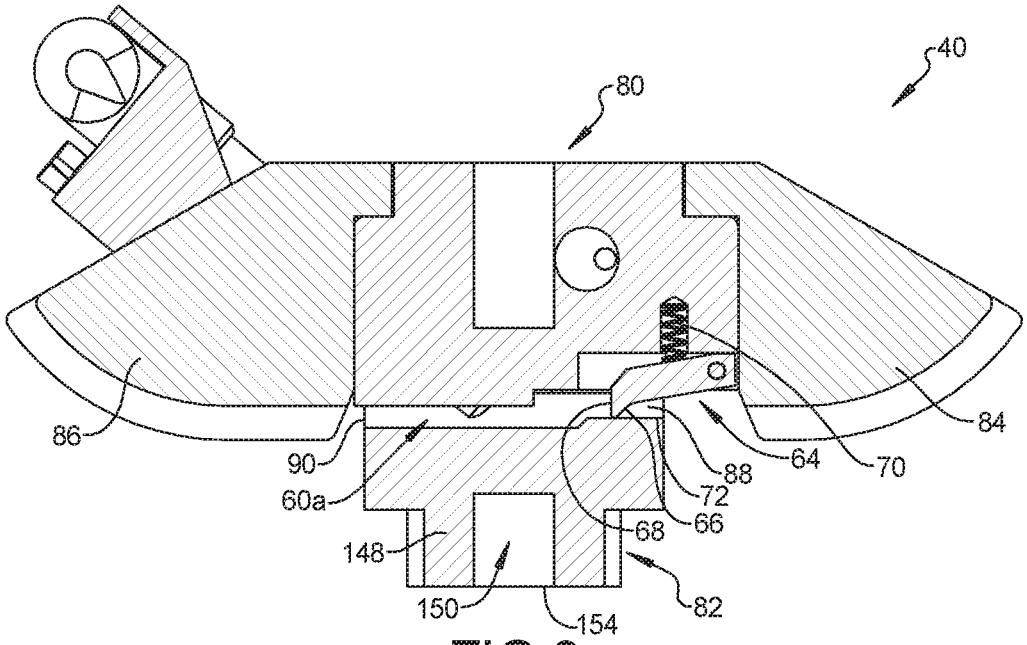
FIG. 9 is a cross-section view of the receiver assembly taken along line 9-9 of FIG. 8.

Example embodiments will now be described more fully with reference to the accompanying drawings.

With reference to FIGS. 1-12, one example of a tape feed apparatus 20 and method for a self-piercing rivet machine 22 is described below. The self-piercing rivet machine 22 can include a self-piercing rivet spindle 24 with a self-piercing rivet punch 26, and can include a C-frame 28 with a self-piercing rivet die 30. The spindle 24 can be mounted on the C-frame 28 for axial movement toward and away from the die 30. The punch 26 and the die 30 can be axially aligned with each other to cooperatively set a self-piercing rivet fastener 32 in a workpiece 18. The machine 22 can be coupled to an articulating robot arm 16 that can position the spindle 24 and die 30 in various locations and orientations relative to various workpieces.

The tape feed apparatus 20 can include a receiver assembly 40. The receiver assembly 40 can be mounted to the working or distal end 42 of the spindle 24 with the punch path 34 extending through the receiver assembly 40.

The tape feed apparatus 20 can include a supply reel 36 that can be coupled on a rivet supply side of the C-frame 28 and can include an exhaust reel 38 that can be coupled to an opposite, exhaust side of the C-frame 28. For example, the supply reel 36 can be mounted on supply reel coupling 46 that can rotate the supply reel 36 about its central axis. For example, the supply reel coupling 46 can be operably coupled to a supply servo controlled motor 48 to rotate the supply reel 36 in forward and reverse directions at variable torques. The supply reel 36 can be designed to be reusable. For example, the supply reel 36 can be made of a durable material, such as plastic, metal, or a combination thereof, so that it is reusable.

The supply reel 36 can include a fastener carrier tape 44 wound thereon. The tape 44 can have a plurality of rivet apertures 56 extending along or down the center of the tape 44. A self-piercing rivet fastener 32 can be mounted in each of the rivet apertures 56 wound on the tape 44. The tape 44 can also have a pair of positioning apertures 58 corresponding to each of the rivet apertures 56. The positioning aperture pairs 58 can extend along opposite lateral sides of the tape 44.

The exhaust reel 38 can be mounted on exhaust reel coupling 52 that can rotate the exhaust reel 38 about its central axis. For example, the exhaust reel coupling 52 can be operably coupled to an exhaust servo controlled motor 54 to rotate the exhaust reel 38 in forward and reverse directions at variable torques. The exhaust reel 38 can be designed to be disposable after a single use, and can be made of a recyclable material. For example, the exhaust reel 38 can be primarily made of a recyclable or disposable material, such as cardboard, so that it is disposable and recyclable.

A lead end of the tape 44 without self-piercing rivets 32 in the rivet apertures 56 can be coupled to the exhaust reel 38 for winding thereon. For example, any of a clip, hook, or protrusion (not shown) can be provided on the exhaust reel 38 that can engage or couple with any of the rivet apertures 56 and positioning apertures 58. Rotation of the exhaust reel 38 in forward and reverse directions facilitates winding or unwinding of the tape 44 on the exhaust reel 38.

A tape path 60 can extend in a forward direction "F" from the supply reel 36, through the receiver assembly 40, and toward or to the exhaust reel 38. The tape path 60 also extends in a reverse direction "R" from the exhaust reel 38, through the receiver assembly 40, and toward or to the supply reel 36. Intermediate tape guides 62 through which the tape 44 can pass. These intermediate tape guides 62 can further define the tape path 60 and insure proper orientation and alignment of the tape 44 along the tape path 60. Rotation of the supply reel 36 in a corresponding reverse direction can pull the tape 44 from the exhaust reel 38 along the tape path 60 in the reverse direction "R." Similarly, rotation of the exhaust reel 38 in a corresponding forward direction pulls the tape 44 from the supply reel 36 along the tape path 60 in the forward direction "F."

The receiver assembly 40 can be designed to receive self-piercing rivets 32 carried by the tape 44 along the tape path 60 below the self-piercing rivet punch 26 of the spindle 24. The receiver assembly 40 can include a pair of reverse locking pawls 64 designed to permit movement of the tape 44 along the tape path 60 in the forward direction "F." For example, a rearward face 66 of the reverse locking pawls 64 can be angled so they will glide over the positioning apertures 58 without engaging them and stopping the tape 44 as the tape 44 moves in the forward direction. The locking pawls 64 can remain at a static pawl position along the tape path.

The reverse locking pawls 64 can also be designed to engage a corresponding pair of the positioning apertures 58 of the tape 44 to stop movement of the tape 44 in the reverse direction "R." For example, a forward face 68 of the reverse locking pawls 64 can be angled so they will engage the positioning apertures 58 and stop the tape 44 as the tape 44 moves in the reverse direction when a lead self-piercing rivet 32L in the rivet apertures 56 is aligned with the punch 26. Thus, this engagement of the reverse locking pawls 64 with the positioning apertures 58 includes a coupling or locking between the two features, which stops movement of the tape in the reverse direction to stop.

Application of a position retention supply torque to the supply reel 36 in the corresponding reverse direction can then maintain the coupling or locking between the reverse locking pawls 64 and the corresponding positioning apertures 58L, to keep the lead self-piercing rivet 32L aligned with the punch 26 and punch path 34. Simultaneous or concurrent application of a position retention exhaust torque to the exhaust reel 38 in the corresponding forward direction that is less than the position retention supply torque can further aid in insuring accurate positioning and alignment of the lead self-piercing rivet 32L with the punch 26 and punch path 34. While the lead self-piercing rivet 32L is aligned with the punch 26 and punch path 34, the spindle 24 can be activated, driving the punch 26, which in turn drives the lead self-piercing rivet 32L from the lead rivet aperture 56L and into the workpiece sandwiched between the receiver assembly 40 and the die 30.

The reverse locking pawls 64 can be pivotably mounted for movement between a retracted and an extended position. A biasing member 70, such as a spring, can be provided to bias the reverse locking pawls 64 toward the extended position. The receiver assembly 40 can include a tape support or positioning surface 72 adjacent the reverse locking pawls 64 that is designed to insure proper positioning of the tape 44 relative to the locking pawls 64 to provide the intended interaction therebetween. Thus, the reverse locking pawls 64 can be is positioned by the receiver assembly 40 to contact and slide along an opposing tape surface 74, such as the upper surface, of the tape 44. In addition, the receiver assembly 40 can support the opposing surface 74 of the tape 44 in a position relative to the reverse locking pawls 64 that the surface 74 can engage the reverse locking pawls 64 to push them against the biasing member toward their retracted positions.

The receiver assembly 40 can include a hard rivet stop 76 positioned to engage the lead self-piercing rivet 32L to stop movement of the tape 44 in the forward direction. The hard rivet stop 76 can be spaced from the reverse locking pawls 64 at a distance from the reverse locking pawls 64 that insures the reverse locking pawls 64 engage the corresponding pair of positioning apertures 58L to stop movement of the tape 44 in the reverse direction when the lead self-piercing rivet 32L in the rivet apertures 56 is aligned with the rivet punch 26 and the punch path 34. As just one example, the corresponding pair of positioning apertures 58L can be two reverse positioning apertures 58 in the reverse direction from the rivet aperture 56L holding the lead rivet 32L.

The receiver assembly 40 can include a rivet sensor 78 positioned to detect a presence of the lead self-piercing rivet 32L when it is within the receiver assembly 40 adjacent the rivet stop 76. For example, the rivet sensor 78 can be positioned to detect the presence of the lead self-piercing rivet 32L when this rivet is at a distance from the reverse locking pawls 64 that insures that they engage the corresponding positioning apertures 58L to stop movement of the tape 44 in the reverse direction when the lead self-piercing rivet 32L is aligned with the rivet punch 26 and the punch path 34. The rivet sensor 78 can, in some cases, be an induction sensor. In other cases, the rivet sensor 78 can be a magnetic sensor or a vision sensor.

This example embodiment includes a tool-free clamshell opening tape feed receiver assembly 40 of the self-piercing rivet machine 22. As used in this context herein, "tool-free" means the tool-free interlock coupling is designed to be manually changed between a locked configuration and an unlocked configuration without the use of tools. The clamshell receiver assembly 40 can be rigidly coupled to an end of a self-piercing rivet spindle 24 to receive self-piercing rivets 32 carried by the tape 44 along the tape path 60 and support a lead self-piercing rivet 32L in alignment with a punch path 34 of the punch 26 of the spindle 24. An upper receiver body 80 and a lower receiver body 82 can be hingedly coupled in a clamshell opening configuration to form a clamshell receiver assembly 40. The upper body 80 can include a tape entry guide 84 and a tape exit guide 86 on opposite sides of that portion of the self-piercing rivet tape path 60*a* which extends through the clamshell receiver assembly 40 upper body 80 and a lower body 82.

In the closed position, this receiver tape path 60*a* can extend between the entry opening 88 and the exit opening 90 adjacent the entry guide 84 and the exit guide 86, respectively. This receiver tape path 60*a* can extend through the clamshell receiver assembly 40 between the upper body 80 and lower body 82 in the closed position. The lower body 82 can include a discharge passage extension 148 that defines an internal self-piercing rivet discharge passage 150. The rivet discharge passage 150 can extend from a proximal end 152 at or adjacent the receiver tape path 60*a* to a distal end 154. At the distal end 154 of the rivet discharge passage 150, the discharge extension 148 of the lower body 82 of the receiver 40 can be engaged with a workpiece 18 and can sandwich one or more workpieces 18 between the receiver assembly 40 and the die 30. The rivet discharge passage 150 can be aligned with a lead self-piercing rivet cavity 106 that houses the lead self-piercing rivet 32L of the tape 44 when the lead self-piercing rivet 32L is aligned with the self-piercing rivet punch 26. Thus, both the lead rivet cavity 106 and the rivet discharge passage 150 can be aligned with each other and with the self-piercing rivet punch 26. When the punch 26 is actuated, it engages the lead rivet 32L in the lead rivet cavity 106 to punch the lead rivet 32L out of the tape 44 and into the proximal end 152 of the discharge passage 150, through the discharge passage 150, and out through the distal end 154 of the discharge passage 150. Thus, the rivet 32L can travel the entire length of the discharge passage 150, entering at the proximal end 152 and exiting at the distal end 154 thereof.

The clamshell receiver assembly 40 can hinge into an open position between the upper receiver body 80 and the lower receiver body 82 along a longitudinal length of the self-piercing rivet tape path 60*a* that extends through the clamshell receiver assembly 40. This longitudinal length of the self-piercing rivet tape path 60*a* along which the upper body 80 and lower body 82 open can span across the lead rivet cavity 106 of the clamshell receiver assembly 40 in which the lead self-piercing rivet 32L of the tape 44 can be supported in alignment with the punch path 34 of the punch 26 of the spindle 24. This longitudinal length along which the upper body 80 and lower body 82 open can span across the entire length of the tape path 60*a* through the clamshell receiver assembly 40 between the entry opening 88 and the exit opening 90. Thus, the tape 44 can be positioned into, or removed from, the tape path 60*a* through the clamshell receiver assembly 40 while both ends of the tape are each coupled to one of the supply reel 36 and exhaust reel 38, respectively. In other words, a midpoint of the tape 44 can be side-loaded and side-unloaded from the clamshell receiver assembly 40. This avoids the need to feed the leading or trailing end of the tape 44 into or through the clamshell receiver assembly 40 and out the other side.

The hinge 92 can include a central collar protrusion 94 extending from the lower receiver body 82. A pair of outer collar protrusions 96 can extend from the upper body 80. The central collar protrusion 94 can be sandwiched between the outer collar protrusions 96 to resist torsion relative to an axis of a hinge pin 98 extending through the hinge protrusions 94, 96. For example, planar opposite lateral surfaces 100 of the central hinge collar protrusion 94 can fit closely and engage against planar opposing surfaces 102 of the outer hinge collar protrusions 96.

A tool-free interlock coupling 104 can have a locked configuration (e.g., FIG. 10) in which the upper receiver body 80 and the lower receiver body 82 of the clamshell receiver assembly 40 are rigidly coupled together in a closed position. The tool-free interlock coupling 104 can have an unlocked configuration (e.g., FIG. 11) in which the upper receiver body 80 and the lower receiver body 82 of the clamshell receiver assembly 40 are hingedly movable into the open position.

The tool-free interlock coupling 104 can include a rod 108 slidably mounted to the clamshell receiver assembly 40. The rod 108 can include a first or mounting end 110 and a locking end 112 and the two ends 110, 112 can extend beside and parallel to each other with a connecting portion 114 extending between the two ends 110, 112. The connecting portion 114 can be curved, which can provide the rod 108 with an overall U-shaped configuration. The mounting end 110 can extend through a mounting aperture 116 to at least partially slidably couple the rod 108 to the clamshell receiver assembly 40. The mounting aperture 116 can be provided through a mounting protrusion 118 of the upper body 80, as in this example. A biasing member 122, such as the illustrated spring, can be mounted on the mounting end 110 of the rod 108 between the mounting protrusion 118 and a distal end 131 thereof to bias the rod 108 toward a locked rod position corresponding to the locked configuration.

The locking end 112 of the rod 108 can be slidable relative to and engageable in a locked configuration with a first locking surface 120. The first locking surface 120 can be provided by an interior surface of a locking aperture 124. The locking aperture 124 can be provided through a mounting or locking protrusion 126 of the upper body 80, as in this example. The locking end 112 of the rod 108 can also be slidable relative to and engageable in a locked configuration with a second locking surface 128. The second locking surface 128 can be provided by an interior surface of a locking aperture 132. The locking aperture 132 can be provided through a locking protrusion 134 of the lower body 82, as in this example. The locking end 112 of the rod 108 can also be slidable relative to and engageable in a locked configuration with a third locking surface 136. The third locking surface 136 can be provided by a surface of a locking protrusion 140 of the upper body 82, as in this example.

Figure 10:
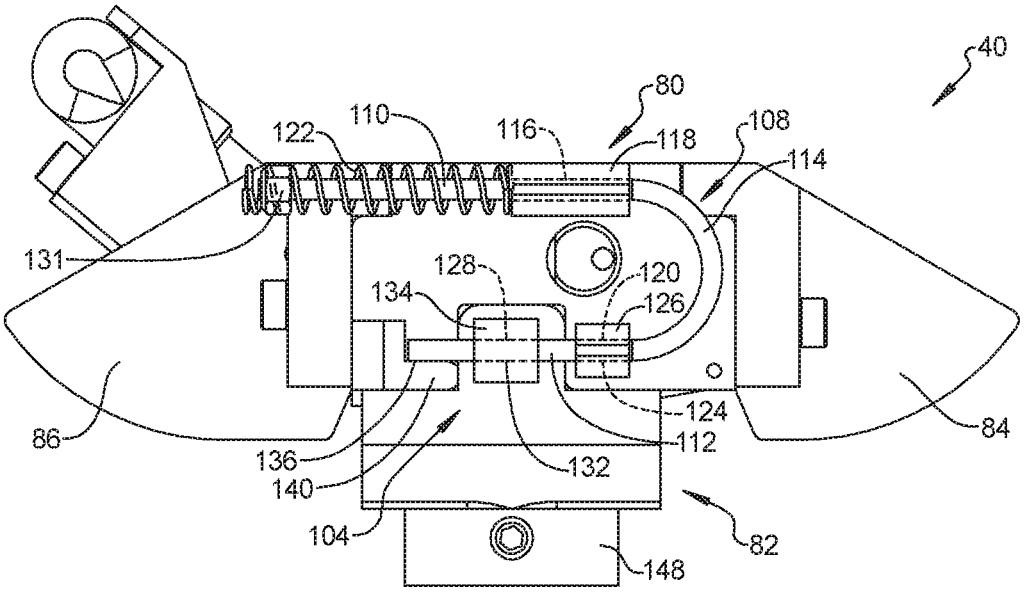
FIG. 10 is a front elevation view of the receiver assembly of the tape feed apparatus of FIG. 1.
Figure 11:
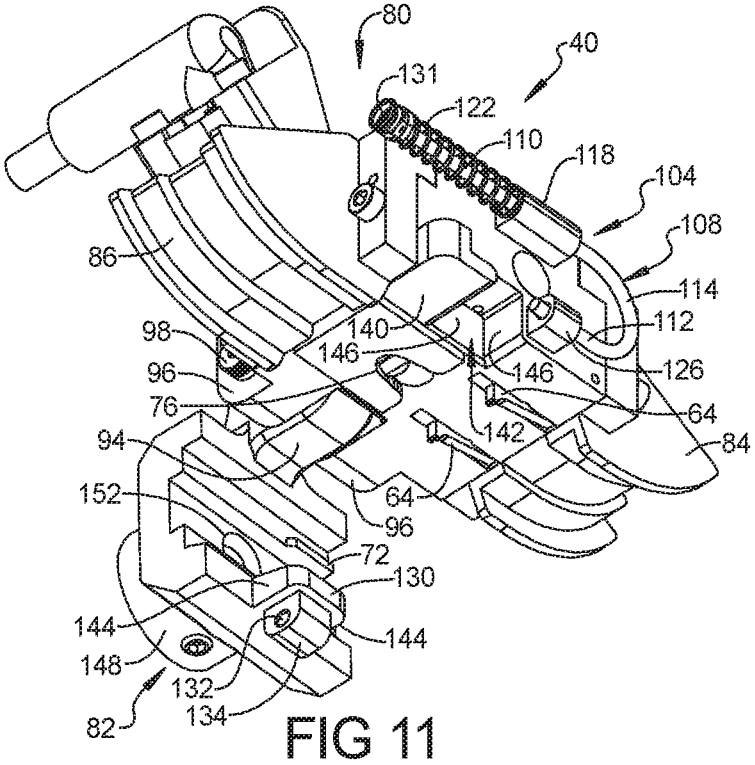
FIG. 11 is a perspective view of the receiver assembly of the tape feed apparatus of FIG. 1, with the receiver hinged into an open position.
Figure 12:
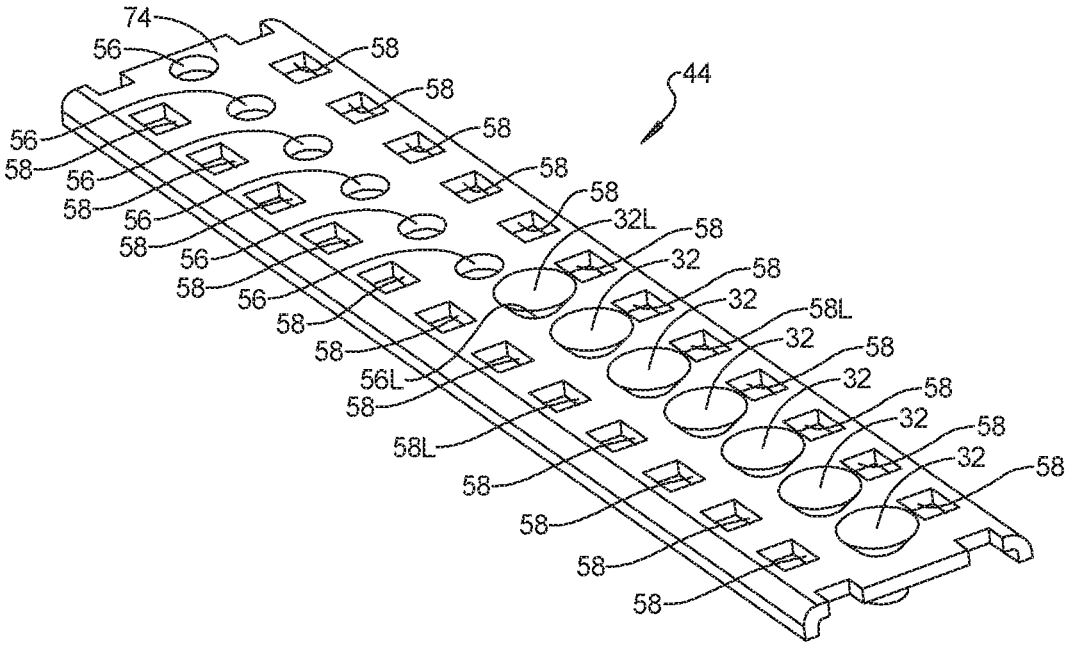
FIG. 12 is a perspective view of a self-piercing rivet carrier tape of the tape feed apparatus of FIG. 1.

The rod can be manually slidable between an unlocked position corresponding to the unlocked configuration of the tool-free interlock coupling and of the upper and lower clamshell receiver bodies 80, 82 (FIG. 11) and a locked position corresponding to the locked configuration of the tool-free interlock coupling and of the upper and lower clamshell receiver bodies 80, 82 (FIG. 10). Thus, in the locked configuration of this example, opposite ends of the locking end 112 of the rod 108 can be simultaneously engaged with the first locking surface 120 and the third locking surface 136, respectively, while a middle of the locking end 112 of the rod 108 is also engaged with the second locking surface 128. In other words, the locking end 112 of the rod 108 can sequentially engage the first locking surface 120, then engage the second locking surface 128, and then engage the third locking surface 136 in the locked configuration. This can help provide a particularly good coupling that rigidly holds the upper and lower bodies 80, 82 in a fixed position relative to each other.

Opposite the hinge 92, an upwardly-extending protrusion 130 of the lower receiver body 82 can be extendable into a corresponding mating pocket 142 of the upper receiver body 80 to resist movement of the upper and lower receiver bodies 80, 82 relative to each other when the tool-free interlock coupling 104 is in the locked configuration. The upwardly-extending protrusion 130 and cooperating mating pocket 142 can include adjacent planar opposing surfaces 144 and 146, respectively. These surfaces 144, 146 can engage against each other to insure the upper and lower receiver bodies 80, 82 are rigidly fixed in position relative to each other when the interlock coupling 104 locks the receiver bodies 80, 82 together in the locked configuration. Some or all of the adjacent planar opposing surfaces 144 and 146 can be angled or wedge shaped. The locking protrusion 134 of the clamshell receiver assembly 40 can extend laterally outwardly from the upwardly-extending protrusion 130 and the second locking surface 128 of the tool-free interlock coupling 104 can be provided via an aperture 132 of the locking protrusion 130.

The rod 108 of the tool-free interlock coupling 104 can be slidable from the locked position corresponding to the locked configuration toward an unlocked position corresponding to the unlocked configuration to disengage the locking end 112 of the rod 108 from the third locking surface 136 and from the second locking surface 128. This can allow the lower clamshell receiver body 82 to pivot via the hinge 92 into an open position.

Because the clamshell receiver assembly 40 separates along a longitudinal length of the tape path 60*a*, throughout this length the upper and lower bodies 80, 82 can open across an entire transverse width of the tape path 60*a* and of the lead rivet cavity 106, and can separate the tape path 60*a* and the lead rivet cavity 106 into upper and lower halves or portions. This can provide essentially full open access the entirety of both the receiver tape path 60*a* and the lead rivet cavity 106. This can be invaluable when there is a need to identify and resolve problems within these areas 60*a*, 106, such as when a rivet 32 becomes jammed therein. Similarly, the clamshell receiver assembly 40 can separate the upper and lower bodies 80, 82 at or above the proximal end 152 of the discharge passage 150. Again, this is invaluable in determining whether there is a rivet jam within the discharge passage 150 and in clearing any such jam from and through the ends 150, 152 of the discharge passage 150. The tool-free interlock coupling 104 does not require locating or keeping track of any tools or fasteners in order to unlock and open the clamshell receiver assembly 40 or to close and re-lock the clamshell receiver assembly 40. This greatly simplifies and reduces the time necessary to open and close the clamshell receiver assembly 40 in order to load or unload tape 44 through the clamshell receiver assembly 40 or to access key interior locations within the clamshell receiver assembly 40 to solve problems therein. This can greatly minimize the downtime of a self-piercing rivet machine 22 and of an assembly line incorporating such machines 22.

Example methods related to a tape feed apparatus 20 in accordance with this disclosure can include rotating the exhaust reel 38 in a corresponding forward direction to move the tape 44 in the forward direction along the tape path 60. This rotating the exhaust reel 38 in the corresponding forward direction to move the tape 44 in the forward direction along the tape path 60 can include applying a forward torque to the exhaust reel 38. A reverse counter-torque that is less than the forward torque can be simultaneously or concurrently applied to the supply reel 36 while this forward torque is being applied to the exhaust reel 38 to help minimize problematic slack in the tape 44.

This movement of the tape 44 along the tape path 60 in the forward direction can be stopped after a lead self-piercing rivet 32L of the tape has moved to a position along the tape path 60 that is beyond, past, or forward of an alignment position of the lead self-piercing rivet 32L with the self-piercing rivet punch 26 and punch path 34. This stopping of the movement of the tape 44 in the forward direction can include ceasing the rotation of the exhaust reel 38 in the corresponding forward direction, which can include ceasing the application of the forward torque to the exhaust reel 38.

This stopping of the movement of the tape 44 in the forward direction can include engaging or contacting the lead self-piercing rivet 32L against the fixed physical or hard rivet stop 76 of the clamshell receiver assembly 40 that is at or adjacent the position along the tape path 60 that is beyond, past or forward of the alignment position along the tape path 60. In addition, this stopping of the movement of the tape 44 in the forward direction can include engaging or contacting the lead self-piercing rivet 32L against the fixed physical or hard rivet stop 76, which is spaced from the reverse locking pawls 64 at a distance from the reverse locking pawls 64 that insures the reverse locking pawls 64 engage the corresponding pair of positioning apertures 58L during the movement of the lead self-piercing rivet 32L from the position along the tape path 60 that is beyond, past, or forward of the alignment position back toward the alignment position.

This stopping of the movement of the tape 44 in the forward direction can alternatively or additionally include the rivet sensor 78 detecting the presence of the lead self-piercing rivet 32L when it is at or adjacent the position along the tape path 60 that is beyond, past, or forward of the alignment position along the tape path 60. In addition, this stopping of the movement of the tape 44 in the forward direction can include detecting the presence of the lead self-piercing rivet 32L with the rivet sensor 78 when the lead self-piercing rivet 32L is at a sensed location that is at or adjacent the position beyond, past, or forward of the alignment position. This position beyond the alignment position is spaced from the reverse locking pawls 64 at a distance from the reverse locking pawls 64 that insures the reverse locking pawls 64 engage the corresponding pair of positioning apertures 58L during the movement of the lead self-piercing rivet 32L from the position along the tape path 60 that is beyond, past or forward of the alignment position back toward the alignment position.

The supply reel 36 can be rotated in a corresponding reverse direction to move the tape 44 in the reverse direction along the tape path 60 and to move the lead self-piercing rivet 32L from the position along the tape path beyond, past, or forward of the alignment position back toward the alignment position with the self-piercing rivet punch 26 and punch path 34. This rotating of the supply reel 36 in the corresponding reverse direction to move the tape 44 in the reverse direction along the tape path 60 can include applying a reverse torque to the supply reel 36. A forward counter-torque that is less than the reverse torque can be simultaneously or concurrently applied to the exhaust reel 38 while this reverse torque is being applied to the supply reel 36 to help minimize problematic slack in the tape 44.

This movement of the tape 44 along the tape path 60 in the reverse direction can be stopped when the lead self-piercing rivet 32L of the tape 44 is positioned along the tape path 60 in the alignment position with the self-piercing rivet punch 26 and punch path 34. This stopping of the movement of the tape 44 in the reverse direction along the tape path 60 comprises engaging reverse locking pawls 64 of the clamshell receiver assembly 40 with rivet positioning apertures 58L that correspond to the lead rivet aperture 56L carrying the lead self-piercing rivet 32L.

A position retention supply torque can be applied to the supply reel 36 in the corresponding reverse direction to maintain the coupling or locking between the reverse locking pawls 64 and the corresponding positioning apertures 58L, to keep the lead self-piercing rivet 32L aligned with the punch 26 and punch path 34. In some cases, the position retention supply torque can have the same magnitude to that of the reverse torque being applied to the supply reel 36. In other cases, the position retention supply torque can have a magnitude that is less than, or greater than that of the reverse torque being applied to the supply reel 36.

A position retention exhaust torque can be simultaneously or concurrently applied to the exhaust reel 38 in the corresponding forward direction simultaneously or concurrently with the position retention supply torque being applied to the supply reel 36. This position retention exhaust torque can be less than the position retention supply torque to further aid in insuring accurate positioning and alignment of the lead self-piercing rivet 32L with the punch 26 and punch path 34. In some cases, the position retention exhaust torque can have the same magnitude to that of the forward counter-torque being applied to the exhaust reel 38. In other cases, the position retention exhaust torque can have a magnitude that is less than or greater than that of the forward counter-torque being applied to the exhaust reel 38.

While the lead self-piercing rivet 32L is aligned with the punch 26 and punch path 34, the spindle 24 can be activated, driving the punch 26, which in turn drives the lead self-piercing rivet 32L from the lead rivet aperture 56L and into the workpiece sandwiched between the clamshell receiver assembly 40 and the die 30.

The foregoing description of example embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

In addition, it will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation, in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A tool-free clamshell opening tape feed receiver assembly for a self-piercing rivet machine, comprising:

an upper receiver body and a lower receiver body hingedly coupled together to form the clamshell receiver assembly;

a self-piercing rivet tape path extending through the clamshell receiver assembly between the upper and lower receiver bodies in a closed position, the clamshell receiver assembly opening into an open position between the upper and lower receiver bodies along a longitudinal length of the self-piercing rivet tape path extending through the clamshell receiver assembly; and a tool-free interlock coupling having a locked configuration in which the upper and lower receiver bodies of the clamshell receiver assembly are rigidly coupled together in the closed position, the tool-free interlock coupling having an unlocked configuration in which the upper and lower receiver bodies of the clamshell receiver assembly are hingedly movable into the open position;

wherein the clamshell receiver assembly is rigidly coupleable to an end of a self-piercing rivet spindle to receive self-piercing rivets carried by a tape along the tape path and support a lead self-piercing rivet in alignment with a punch of the spindle.

2. The tool-free clamshell opening tape feed receiver assembly for a self-piercing rivet machine of claim 1, wherein the longitudinal length of the self-piercing rivet tape path extending through the clamshell receiver assembly spans across a lead rivet cavity of the clamshell receiver assembly.

3. The tool-free clamshell opening tape feed receiver assembly for a self-piercing rivet machine of claim 1, wherein the longitudinal length is an entire longitudinal length of the self-piercing rivet tape path extending through the clamshell receiver assembly.

4. The tool-free clamshell opening tape feed receiver assembly for a self-piercing rivet machine of claim 1, wherein the tool-free interlock coupling comprises a rod slidably mounted on the clamshell receiver assembly, the rod being slidable to engage a first locking surface of a first of the upper and lower receiver bodies and to engage a second locking surface of a second of the upper and lower receiver bodies in the locked configuration, and the rod being slidable to disengage the rod from the second locking surface in the unlocked configuration.

5. The tool-free clamshell opening tape feed receiver assembly for a self-piercing rivet machine of claim 4, wherein an interior surface of a first locking aperture defines the first locking surface and an interior surface of a second locking aperture defines the second locking surface.

6. The tool-free clamshell opening tape feed receiver assembly for a self-piercing rivet machine of claim 4, wherein the tool-free interlock coupling comprises a third locking surface of the first of the upper and lower receiver bodies, the rod being slidable to engage each of the first, second, and third locking surfaces in the locked configuration and slidable to disengage from at least the second and third locking surfaces in the unlocked configuration.

7. The tool-free clamshell opening tape feed receiver assembly for a self-piercing rivet machine of claim 6, wherein the rod sequentially engages the first locking surface, then the second locking surface, and then the third locking surface in the locked configuration.

8. The tool-free clamshell opening tape feed receiver assembly for a self-piercing rivet machine of claim 6, wherein first, second, and third protrusions of the clamshell receiver assembly comprise the first, second, and third locking surfaces, respectively.

9. The tool-free clamshell opening tape feed receiver assembly for a self-piercing rivet machine of claim 4, wherein a biasing member biases the rod toward a locked rod position corresponding to the locked configuration.

10. The tool-free clamshell opening tape feed receiver assembly for a self-piercing rivet machine of claim 4, wherein the rod comprises two ends extending beside and parallel to each other and a connecting portion extending between the two ends.

11. The tool-free clamshell opening tape feed receiver assembly for a self-piercing rivet machine of claim 10, wherein a first of the two ends is a mounting end that extends through a mounting aperture to slidably couple the rod to the clamshell receiver assembly, and a second of the two ends is a locking end that is engageable with the first and second locking surfaces.

12. The tool-free clamshell opening tape feed receiver assembly for a self-piercing rivet machine of claim 11, wherein a biasing member is mounted on the mounting end of the rod between a distal end thereof and the mounting aperture to bias the rod toward a locked rod position corresponding to the locked configuration.

13. The tool-free clamshell opening tape feed receiver assembly for a self-piercing rivet machine of claim 1, wherein the upper and lower receiver bodies are hingedly coupled together at a hinge comprising a central collar protrusion extending from a first of the upper and lower receiver bodies, and a pair of outer collar protrusions extending from a second of the upper and lower receiver bodies, and wherein the central collar protrusion is sandwiched between the outer collar protrusions to resist lateral torsion with respect to an axis of a hinge pin extending through the central and outer collar protrusions.

14. The tool-free clamshell opening tape feed receiver assembly for a self-piercing rivet machine of claim 13, wherein opposite the hinge an upwardly-extending protrusion of a first of the upper and lower receiver bodies is extendable into a corresponding mating pocket of a second of the upper and lower receiver bodies to resist movement of the upper and lower receiver bodies relative to each other when the tool-free interlock coupling is in the locked configuration.

15. The tool-free clamshell opening tape feed receiver assembly for a self-piercing rivet machine of claim 14, wherein the tool-free interlock coupling comprises a rod slidably mounted on the clamshell receiver assembly, the rod being slidable to engage a first locking surface of a first of the upper and lower receiver bodies and to engage a second locking surface of a second of the upper and lower receiver bodies in the locked configuration, and the rod being slidable to disengage the rod from the second locking surface in the unlocked configuration, and wherein a locking protrusion of the clamshell receiver assembly extends laterally outwardly from the upwardly-extending protrusion and the second locking surface of the tool-free interlock coupling is provided on the locking protrusion.

16. A tool-free clamshell opening tape feed receiver assembly for a self-piercing rivet machine, comprising:

an upper receiver body and a lower receiver body hingedly coupled together to form the clamshell receiver assembly;

a self-piercing rivet tape path extending through the clamshell receiver assembly between the upper and lower receiver bodies in a closed position, the clamshell receiver assembly opening into an open position between the upper and lower receiver bodies along a longitudinal length of the self-piercing rivet tape path extending through the clamshell receiver assembly; and a tool-free interlock coupling having a locked configuration in which the upper and lower receiver bodies of the clamshell receiver assembly are rigidly coupled together in the closed position, the tool-free interlock coupling having an unlocked configuration in which the upper and lower receiver bodies of the clamshell receiver assembly are hingedly movable into the open position;

wherein the clamshell receiver assembly is rigidly coupleable to an end of a self-piercing rivet spindle to receive self-piercing rivets carried by a tape along the tape path and support a lead self-piercing rivet in alignment with a punch of the spindle;

wherein the lower receiver body defines a self-piercing rivet discharge passage extending from a proximal end adjacent the tape path to a distal end at which the lower receiver body is engageable with a workpiece; and wherein the discharge passage is designed to receive a self-piercing rivet from the tape extending along the tape path through its proximal end and to pass the self-piercing rivet through the discharge passage and out of the discharge passage through its distal end.

17. The tool-free clamshell opening tape feed receiver assembly for a self-piercing rivet machine of claim 16, wherein the longitudinal length of the self-piercing rivet tape path extending through the clamshell receiver assembly spans across a lead rivet cavity of the clamshell receiver assembly.

18. The tool-free clamshell opening tape feed receiver assembly for a self-piercing rivet machine of claim 16, wherein the longitudinal length is an entire longitudinal length of the self-piercing rivet tape path extending through the clamshell receiver assembly.

19. The tool-free clamshell opening tape feed receiver assembly for a self-piercing rivet machine of claim 16, wherein the tool-free interlock coupling comprises a rod slidably mounted on the clamshell receiver assembly, the rod being slidable to engage a first locking surface of a first of the upper and lower receiver bodies and to engage a second locking surface of a second of the upper and lower receiver bodies in the locked configuration, and the rod being slidable to disengage the rod from the second locking surface in the unlocked configuration.

20. The tool-free clamshell opening tape feed receiver assembly for a self-piercing rivet machine of claim 19, wherein an interior surface of a first locking aperture defines the first locking surface and an interior surface of a second locking aperture defines the second locking surface.

21. The tool-free clamshell opening tape feed receiver assembly for a self-piercing rivet machine of claim 19, wherein the tool-free interlock coupling comprises a third locking surface of the first of the upper and lower receiver bodies, the rod being slidable to engage each of the first, second, and third locking surfaces in the locked configuration and slidable to disengage from at least the second and third locking surfaces in the unlocked configuration.

22. The tool-free clamshell opening tape feed receiver assembly for a self-piercing rivet machine of claim 21, wherein the rod sequentially engages the first locking surface, then the second locking surface, and then the third locking surface in the locked configuration.

23. The tool-free clamshell opening tape feed receiver assembly for a self-piercing rivet machine of claim 21, wherein first, second, and third protrusions of the clamshell receiver assembly comprise the first, second, and third locking surfaces, respectively.

24. The tool-free clamshell opening tape feed receiver assembly for a self-piercing rivet machine of claim 19, wherein a biasing member biases the rod toward a locked rod position corresponding to the locked configuration.

25. The tool-free clamshell opening tape feed receiver assembly for a self-piercing rivet machine of claim 19, wherein the rod comprises two ends extending beside and parallel to each other and a connecting portion extending between the two ends.

26. The tool-free clamshell opening tape feed receiver assembly for a self-piercing rivet machine of claim 25, wherein a first of the two ends is a mounting end that extends through a mounting aperture to slidably couple the rod to the clamshell receiver assembly, and a second of the two ends is a locking end that is engageable with the first and second locking surfaces.

27. The tool-free clamshell opening tape feed receiver assembly for a self-piercing rivet machine of claim 26, wherein a biasing member is mounted on the mounting end of the rod between a distal end thereof and the mounting aperture to bias the rod toward a locked rod position corresponding to the locked configuration.

28. The tool-free clamshell opening tape feed receiver assembly for a self-piercing rivet machine of claim 16, wherein the upper and lower receiver bodies are hingedly coupled together at a hinge comprising a central collar protrusion extending from a first of the upper and lower receiver bodies, and a pair of outer collar protrusions extending from a second of the upper and lower receiver bodies, and wherein the central collar protrusion is sandwiched between the outer collar protrusions to resist lateral torsion with respect to an axis of a hinge pin extending through the central and outer collar protrusions.

29. The tool-free clamshell opening tape feed receiver assembly for a self-piercing rivet machine of claim 28 wherein, opposite the hinge, an upwardly-extending protrusion of a first of the upper and lower receiver bodies is extendable into a corresponding mating pocket of a second of the upper and lower receiver bodies to resist movement of the upper and lower receiver bodies relative to each other when the tool-free interlock coupling is in the locked configuration.

30. The tool-free clamshell opening tape feed receiver assembly for a self-piercing rivet machine of claim 29, wherein the tool-free interlock coupling comprises a rod slidably mounted on the clamshell receiver assembly, the rod being slidable to engage a first locking surface of a first of the upper and lower receiver bodies and to engage a second locking surface of a second of the upper and lower receiver bodies in the locked configuration, and the rod being slidable to disengage the rod from the second locking surface in the unlocked configuration, and wherein a locking protrusion of the clamshell receiver assembly extends laterally outwardly from the upwardly-extending protrusion and the second locking surface of the tool-free interlock coupling is provided on the locking protrusion.

* * * * *